US006293565B1

(12) United States Patent
Bouchard et al.

(10) Patent No.: US 6,293,565 B1
(45) Date of Patent: Sep. 25, 2001

(54) ROLLER HOCKEY GOALIE SKATE

(75) Inventors: Anthony Bouchard, Wilmette, IL (US); Richard J. Bouchard, Jr., Burbank, CA (US)

(73) Assignee: Netminders, Inc., San Francisco, CA (US)

( * ) Notice: Subject to any disclaimer, the term of this patent is extended or adjusted under 35 U.S.C. 154(b) by 0 days.

(21) Appl. No.: 09/338,793

(22) Filed: Jun. 23, 1999

Related U.S. Application Data

(60) Provisional application No. 60/110,907, filed on Dec. 4, 1998.

(51) Int. Cl.[7] ..... A63C 17/00

(52) U.S. Cl. ..... 280/11.226; 280/11.222; 301/5.7

(58) Field of Search ..... 280/841, 11.19, 280/11.221, 11.222, 11.225, 11.226, 11.233, 14.1, 87.041, 87.042, 11.227, 843, 809, 811; 301/5.3, 5.7

(56) References Cited

U.S. PATENT DOCUMENTS 840,953 * 1/1907 Pedersen ..... 280/11.221 X
862,431 * 1/1907 Armband ..... 280/843

(List continued on next page.)

OTHER PUBLICATIONS

Advertising materials from "RollerBall International Inc." web–site, copyright 1998–1999, pp. 3, 4, 5 and 6 of 6.

*Primary Examiner*—Brian L. Johnson
*Assistant Examiner*—Bryan Fischmann

(74) *Attorney, Agent, or Firm*—McCutchen Doyle Brown & Enersen LLP; David G. Beck

(57) ABSTRACT

A skate assembly that allows a skater forward/backward motion as well as side-to-side motion is provided. Various aspects of the skate assembly can be adjusted to fit the size and weight of the skater, the skill level of the skater, the skating or playing style of the skater, and the various surfaces to which it might come into contact. In one configuration the skate assembly is comprised of a plurality of linearly aligned roller assemblies. The skate assembly includes at least one friction plate mounted on the inside edge of the skate frame that provides a push-off area used by the skater to initiate motion, accelerate, or stop. In another configuration the skate assembly is comprised of at least one roller assembly interposed between a pair of conventional wheels. The pair of conventional wheels provides stability when the skater is moving in either a forward or backward direction since these two wheels are confined to rotation in a single plane. When the skater wishes to move laterally he or she tilts the skates, for example by inwardly angling both knees, causing the conventional wheels to be raised from the rolling surface and placing all of the skater's weight on the omni-directional, i.e., substantially spherical, rollers. At this point lateral skate motion is as easy as linear skate motion. The roller within each of the roller assemblies can be mounted between two sets of bearings mounted on either side of the roller; between an upper bearing set and a set of bearings that surrounds the roller; or within a roller cavity that has been coated with a low friction coating.

25 Claims, 6 Drawing Sheets

U.S. PATENT DOCUMENTS

| | | | | |
|---|---|---|---|---|
| 904,088 | * | 11/1908 | Rother . | |
| 1,271,891 | * | 7/1918 | Gustin | 280/843 |
| 1,616,442 | * | 2/1927 | De Festenburg et al. | 280/843 |
| 3,351,353 | * | 11/1967 | Weitzner | 280/11.227 X |
| 3,379,454 | * | 4/1968 | Woodman | 280/87.042 |
| 3,522,951 | * | 8/1970 | Tyson . | |
| 3,789,947 | | 2/1974 | Blumrich . | |
| 3,963,251 | * | 6/1976 | Miano . | |
| 4,076,263 | * | 2/1978 | Rand | 280/843 |
| 4,572,529 | * | 2/1986 | Thomas | 280/11.226 X |
| 5,085,445 | | 2/1992 | Boyden . | |
| 5,207,454 | | 5/1993 | Blankenburg et al. . | |
| 5,382,052 | | 1/1995 | Tarng . | |
| 5,398,949 | | 3/1995 | Tarng . | |
| 5,409,365 | * | 4/1995 | Douglass | 280/87.041 X |
| 5,478,095 | * | 12/1995 | Marandel | 280/11.19 X |
| 5,492,352 | | 2/1996 | St. Clair . | |
| 5,549,331 | | 8/1996 | Yun et al. . | |
| 5,560,625 | | 10/1996 | Kuykendall . | |
| 5,716,074 | | 2/1998 | Theodorou . | |
| 5,720,529 | * | 2/1998 | Barron | 301/5.3 X |
| 5,730,467 | | 3/1998 | Huang . | |
| 5,806,860 | * | 9/1998 | Conte | 280/809 X |
| 5,967,552 | * | 10/1999 | Roderick et al. | 280/843 |
| 6,036,278 | * | 3/2000 | Boyer | 301/5.3 |
| 6,065,762 | * | 5/2000 | Brelvi | 280/11.226 |
| 6,076,857 | * | 6/2000 | Goodman | 280/809 |

* cited by examiner

ROLLER HOCKEY GOALIE SKATE

CROSS REFERENCE TO RELATED APPLICATION

This application claims priority of U.S. Provisional patent application Ser. No. 60/110,907, filed Dec. 4, 1998, incorporated by reference for all purposes.

FIELD OF THE INVENTION

The present invention relates generally to roller skates, and more particularly, to an in-line roller skate that allows lateral movement.

BACKGROUND OF THE INVENTION

In-line roller skates, often referred to as roller blades, are an extremely popular skate that offers the skater both speed and maneuverability. A typical roller blade has either four or five polyurethane wheels linearly aligned and mounted within a wheel frame. The wheel frame can be attached to a variety of different boot types depending upon the needs of the skater. Attached to the boot and/or skate frame is a toe stop, heal stop, or both. Uses of roller blades range from simple recreational skating to professional roller hockey.

As roller blade use has increased, so have the demands placed on the skate assembly. For example, free-style skaters perform difficult skating maneuvers or ticks on both flat and sloping surfaces. One of the more demanding users of roller blades is the roller hockey goaltender or goalie. Both professional and amateur goalies require not only the ability for linear motion, i.e., movement in forward and backward directions, but also the ability for lateral motion, i.e., side-to-side movement. One measure of a goalie's effectiveness is how quickly he or she can move side-to-side, thus indicating how well the goalie can guard the goal. An unfortunate side effect of this lateral motion, even for goalies using state-of-the-art roller hockey skates, is that goalies are constantly twisting their knees, leading to frequent knee injuries.

U.S. Pat. No. 5,398,949 discloses an in-line skate designed to provide the skater with the ability to easily move in a direction other than forward or backward. The disclosed system utilizes a steering mechanism that allows the individual rollers to curve to the right or left, depending upon whether the skater shifts their body weight to the right or left, respectively.

U.S. Pat. No. 5,382,052 discloses an in-line skate that can be used to skate forward, backward, or sideways. The disclosed skate can also turn right, turn left, or spin. The skate uses a composite belt that wraps around all of the in-line wheels similar to the caterpillar treads used on a tractor or military tank. The composite belt is comprised of a resilient belt, string, and beads.

From the foregoing, it is apparent that an in-line roller skate that allows the skater an increased range of motion, in particular side-to-side motion, is desired. The present invention provides such a skate.

SUMMARY OF THE INVENTION

The present invention provides a skate assembly that allows the skater linear forward and backward motion as well as lateral side-to-side motion. The skate assembly can be adjusted to fit the size and weight of the skater, the skill level of the skater, and the skating or playing style of the skater.

In one embodiment of the invention, each skate assembly includes a plurality of roller assemblies, preferably either 4 or 5 roller assemblies. Within each roller assembly ig a roller that can rotate in any direction, thus providing the skater with the flexibility to skate in any direction. This flexibility is especially advantageous for roller hockey goalies that require the ability to skate side-to-side as well as forward and backward or for extreme skaters that perform a variety of difficult skating maneuvers. In order to provide a push-off area that allows the skater to either initiate movement or accelerate, the skate assembly includes a friction plate.

In another embodiment of the invention, each skate assembly includes at least one roller assembly, and preferably at least three roller assemblies, interposed between a pair of conventional wheels. The pair of conventional wheels provides stability when the skater is moving in either a forward or backward direction since these two wheels are confined to rotation in a single plane. When the skater wishes to move laterally he or she tilts the skates, for example by inwardly angling both knees, causing the conventional wheels to be raised from the playing surface and placing all of the skater's weight on the omni-directional rollers. At this point lateral skate motion is as easy as linear skate motion.

In one embodiment of an individual roller assembly the top surface of the roller rests against or is cupped within a first set of bearings. A bearing cage containing a second set of bearings surrounds the roller along a plane below the maximum diameter of the roller, thus capturing the roller between the two bearing sets. Preferably the force applied by the first and second sets of bearings to the roller is adjustable, for example through adjustment of the relative positions of the bearing sets, thus allowing control of the resistance of the roller to motion.

In another embodiment of an individual roller assembly the roller is held within a cavity, the cavity being comprised of at least upper and lower roller housings. A portion of the roller extends out of the cavity to provide the rolling surface. The inner surfaces of the housings that are in contact with the roller are coated with a low friction coating such as a polymer coating, so that the roller can easily rotate within the housing.

In another embodiment of an individual roller assembly the roller is held between two bearing sets mounted on either side of the roller. Each bearing set is held within a retainer that is mounted to the skate assembly frame by tension bolts. Adjustment of the tensioning bolts adjusts the pressure applied by the bearing sets on the roller. Thus the amount of force that is required to rotate the roller can be controlled and tailored to the needs of a particular skater.

A further understanding of the nature and advantages of the present invention may be realized by reference to the remaining portions of the specification and the drawings.

DESCRIPTION OF THE SPECIFIC EMBODIMENTS

Figure 1:
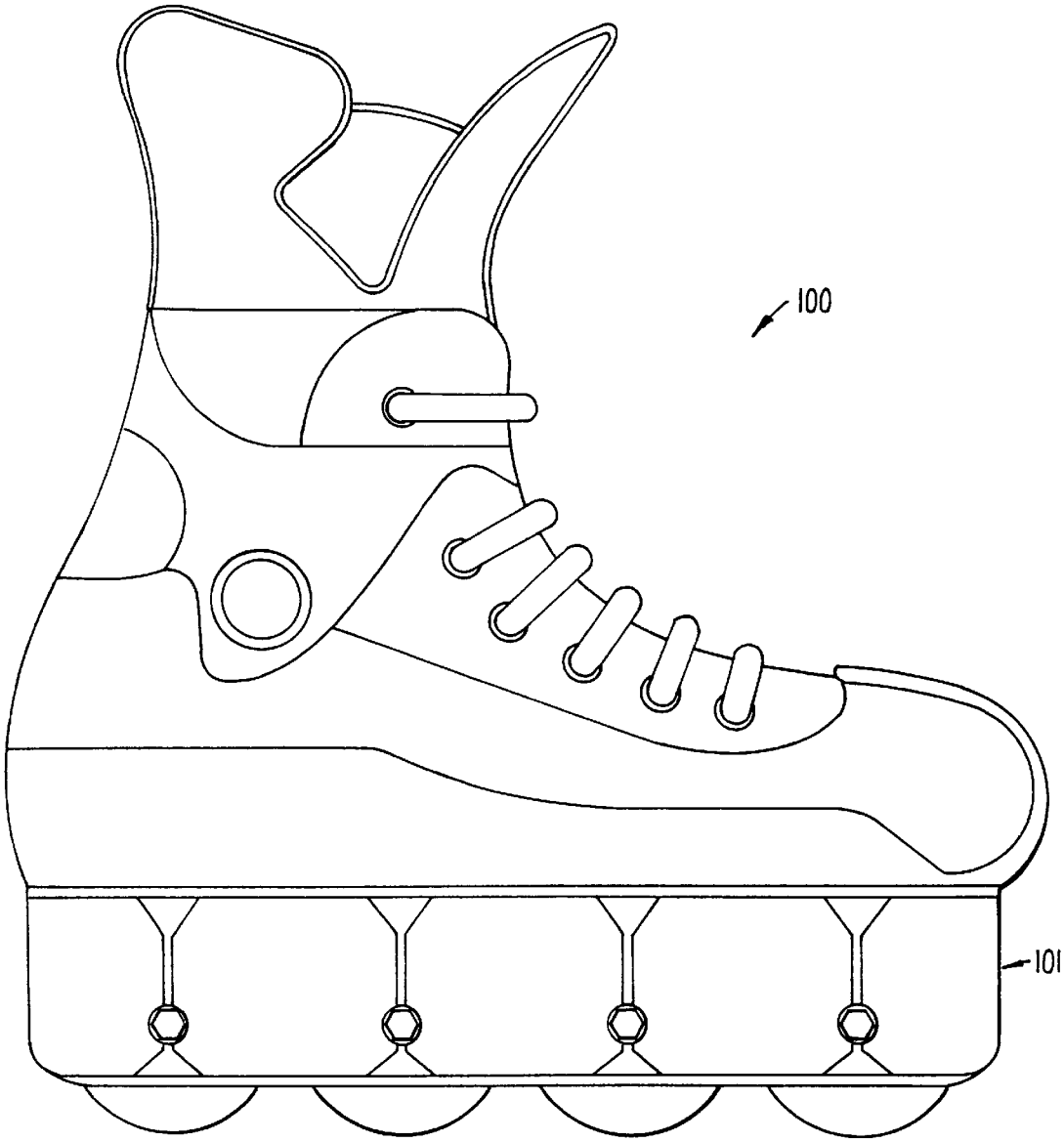
FIG. 1 is an illustration of an embodiment of the invention attached to a skate boot.

FIG. 1 is an illustration of one embodiment of the invention attached to a skate boot 100. Skate boot 100 is fabricated according to standard practices and can be made of any of a variety of materials. For example, the various components of a skate boot (e.g., ankle support, tongue, sole, toe, etc.) are typically made of a polymer, although cloth or nylon fabric, elastomeric material (e.g., natural or synthetic rubber), leather, and light-weight metal may also be used either singly or in combination. The primary considerations in designing boot 100 are the intended user (e.g., professional versus casual roller hockey player) and the desired price. The present invention is intended for use with boot 100 regardless of its design, although the manner in which the invention is attached to the boot may vary depending upon both the boot's design and the intended user. For example, a professional goalie may require the ability to easily and quickly replace roller assembly 101 if the rollers are either damaged or experiencing wear-related problems during play.

Figure 2:
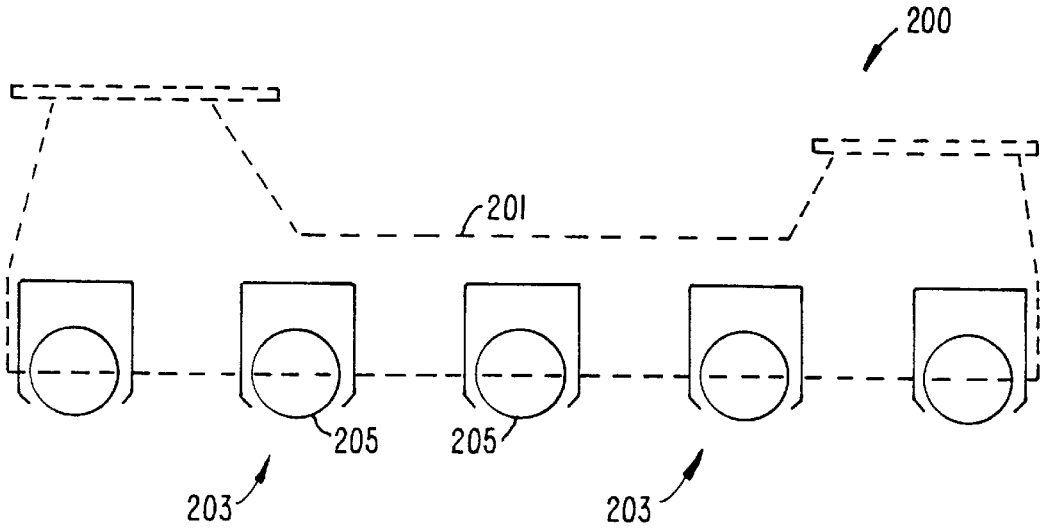
FIG. 2 is a length-wise cross-sectional view of a skate assembly using a plurality of roller assemblies.
Figure 3:
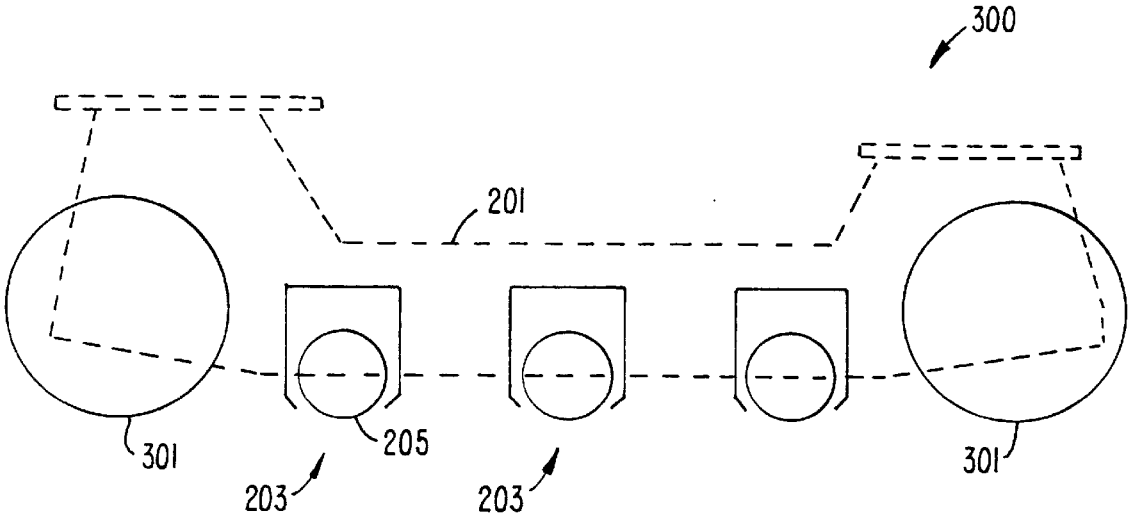
FIG. 3 is a length-wise cross-sectional view of a skate assembly using a plurality of roller assemblies in combination with a pair of conventional roller blade wheels.

FIGS. 2 and 3 are cross-sectional illustrations of two different skate assemblies according to the present invention. Shown in both figures is a frame member 201 that is used to couple the skate assembly to boot 100 (not shown). As noted above, the exact configuration of frame member 201 is not critical to the invention and is simply a matter of design choice. For example, frame member 201 can be constructed of lightweight series 700 aluminum, carbon fiber, or other material and can be attached to boot 100 via bolts, rivets, or other means. Preferably frame member 201 is mounted to boot 100 in a manner that allows easy removal, repair, and/or replacement of the skate assembly. Replacement is especially beneficial to professional roller hockey players as it allows the player to easily vary the number of rollers, the combination of rollers and wheels, etc., thereby minimizing out-of-play time.

Skate assembly 200 includes 5 individual roller assemblies 203. Within each roller assembly 203 is a substantially spherical roller 205 that can rotate in any direction. Although assembly 200 is shown with 5 roller assemblies, both fewer and greater numbers of rollers can be used. The number of rollers is primarily driven by the individual user's performance needs. For example, some skaters prefer the greater stability that 5 or more rollers provide while other skaters prefer to use no more than 4 rollers, thereby minimizing friction. Similarly, the diameter of individual rollers 205 can be varied. Typically the diameter of rollers 205 depends upon the user's height and weight as well as the user's skill level and intended use.

Skate assembly 300 is comprised of both roller blade wheels 301 and rollers assemblies 203. This combination of wheels and rollers is preferable for those skaters that primarily skate in a direction parallel to the plane of the wheels/rollers but that occasionally require enhanced lateral motion. As in skate assembly 200, the number of roller assemblies 203 depends upon the intended user.

Figure 4:
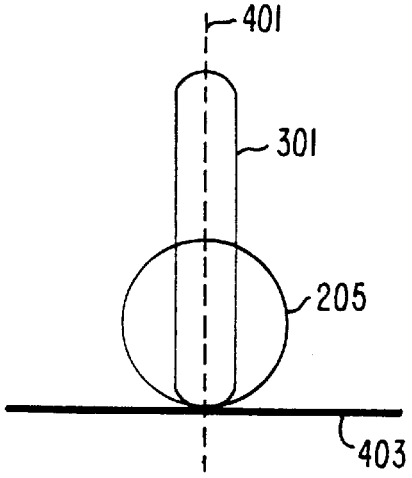
FIG. 4 is an end-on cross-sectional view of the skate assembly shown in FIG. 3 in which the skate assembly is in a fully upright position, thereby providing linear motion similar to a conventional roller blade.
Figure 5:
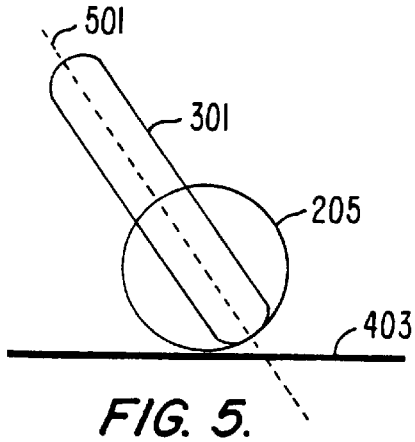
FIG. 5 is an end-on cross-sectional view of the skate assembly shown in FIG. 3 in which the skate assembly is tilted away from a fully upright position, thereby allowing lateral motion unlike a conventional roller blade.

FIGS. 4 and 5 illustrate how skate assembly 300 allows the skater to achieve both stable linear and lateral motion. When the skater is skating in or close to the plane of the wheels/rollers, i.e., linear motion, the skate is generally upright along a plane 401 as shown in FIG. 4, causing both wheels 301 and rollers 205 to be in contact with skating surface 403. Therefore during linear motion the combination of wheels 301 and rollers 205 provides approximately the same amount of surface to wheel/roller area as with a conventional roller blade. Additionally, as in the case of a conventional skate, wheels 301 provide linear stability since they are confined to linear motion, assuming no wheel slippage. In contrast to a conventional skate, however, when the skater requires lateral motion he or she need only lean over or angle the skate along an adjustable plane 501. By doing so wheels 301 are lifted away from surface 403, leaving only spherical rollers 205 in contact with the surface. Since rollers 205 are not confined to roll along a single plane, lateral skate motion is enhanced.

As noted above with regards to skate assembly 300, if the user leans the skate over to a sufficient degree, wheels 301 are lifted away from surface 403 providing the user with greatly improved lateral movement. This same lean, however, also eliminates the standard technique of 'pushing-off' using the wheels.

Figure 6:
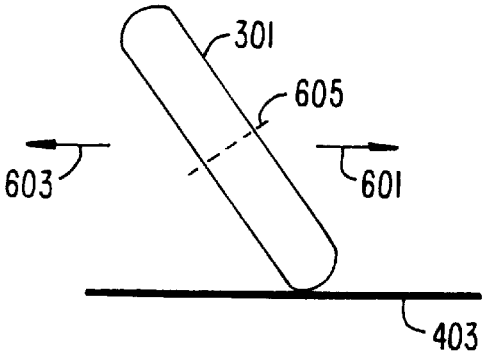
FIG. 6. PRIOR ART
FIG. 6 illustrates the phenomenon that allows a skater to push-off of a conventional roller blade wheel to initiate or accelerate motion.

Generally when a skater needs to either initiate or accelerate motion in a given direction, he or she will apply force in the opposite direction by pushing away from or 'off' of the rolling surface, i.e., surface 403. As illustrated in FIG. 6, in a conventional skate the skater pushes in a direction 601, causing the skater to move in a direction 603. The frictional forces required to apply force in direction 601 are the result of wheels 301 being constrained to rotate around axis 605. In contrast to a conventional skate, if skate assembly 300 is angled sufficiently toward surface 403, wheels 301 will be raised away from the surface leaving only rollers 205 in contact with surface 403. As spherical rollers 205 are free to roll in all directions, much of the friction required to efficiently apply force in direction 601 is lost. Therefore in order for a skater using skate assembly 300 to push-off, it is necessary to control the degree of lean, thereby retaining contact between wheels 301 and surface 403.

Figure 7:
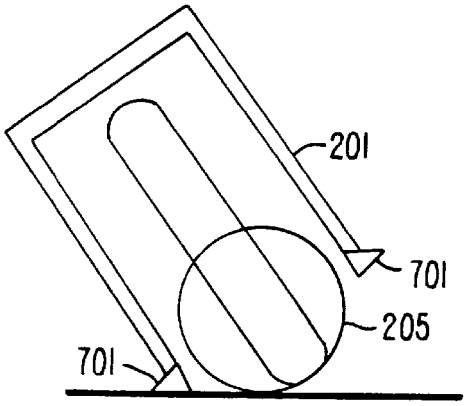
FIG. 7 illustrates a friction plate that can be used with the invention that provides a surface for either pushing-off or stopping.

FIG. 7 illustrates an alternate approach applicable to either skate assembly 200 or skate assembly 300 that allows the skater to push-off. As shown, frame member 201 includes a friction plate 701 that preferably runs the length of the roller assembly. Alternately, friction plate 701 can be comprised of a several individual friction stops. Although the primary need for friction plate 701 is on the inside edge of skate frame 201, it can be applied to both the inner and outer frame edges as illustrated. Preferably friction plate 701, or the portion of plate 701 that is intended to come into contact with surface 403, is fabricated from polyurethane or a high density plastic. Other materials that exhibit suitable friction and wear properties can also be used.

During use with skate assembly 300, as the skater progressively tilts the skate, skate assembly 300 advances through three stages. Initially both wheels 301 and rollers 205 are in contact with surface 403. As the skate assembly tilts, wheels 301 lift from surface 403 leaving only rollers 205 in contact. Finally as skate assembly 300 becomes sufficiently tilted, friction plate 701 comes into contact with surface 403. Although the primary purpose of friction plate 701 is to provide the skater with a convenient means of either stopping or slowing down, friction plate 701 can also be used, at least to a limited extent, as a means of pushing-off. Preferably the height of friction plate 701 is adjustable, for example by using a slotted plate-to-frame coupler, thereby accounting for differences in playing style and ability. Additionally, if friction plate 701 is adjustable, it can be lowered as the plate material is worn away through normal wear. Friction plate 701 can also be used with skate assembly 200.

Figure 8:
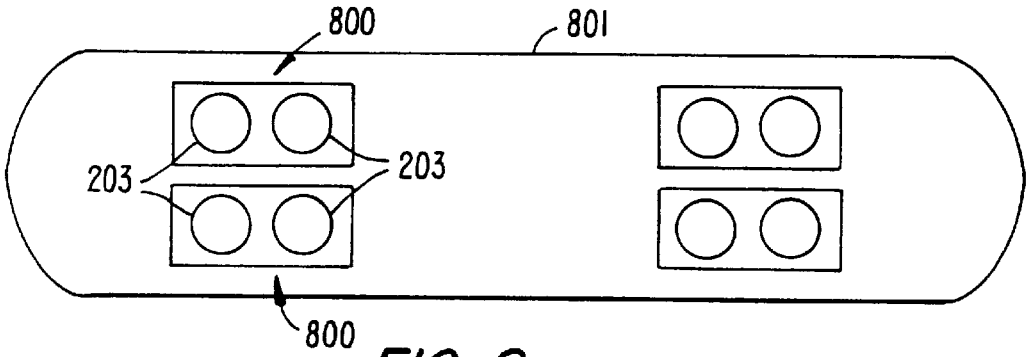
FIG. 8 illustrates an embodiment in which a skate assembly according to the present invention is coupled to a skate board.

Preferably skate assemblies 200 and 300 are used with boot 100 as illustrated above. It should be understood, however, that these skate assemblies can be used with other devices that presently utilize conventional wheel assemblies. For example, FIG. 8 illustrates one embodiment of a skate assembly 800 coupled to a skate board 801. As shown, four skate assemblies 800 are coupled to the bottom surface of skate board 801 although fewer or greater numbers of skate assemblies can be used depending upon the intended use, i.e. maneuvers, of the skate board. Preferably in this embodiment each skate assembly 800 only includes two roller assemblies 203 as shown. Other configurations can also be used, such as fewer or greater numbers of roller assemblies 203 or the use of roller assemblies 203 in combination with conventional wheels as in skate assembly 300. Other applications for roller assemblies 203 are also envisioned. For example, one or more roller assemblies 203 can be permanently or semi-permanently coupled to one or more surfaces of a piece of luggage, thereby providing a rolling surface. The benefit of using roller assemblies 203 rather than conventional wheel assemblies is that the luggage can be easily moved in a variety of directions (e.g., around corners) with minimal risk of the luggage overturning.

Figure 9:
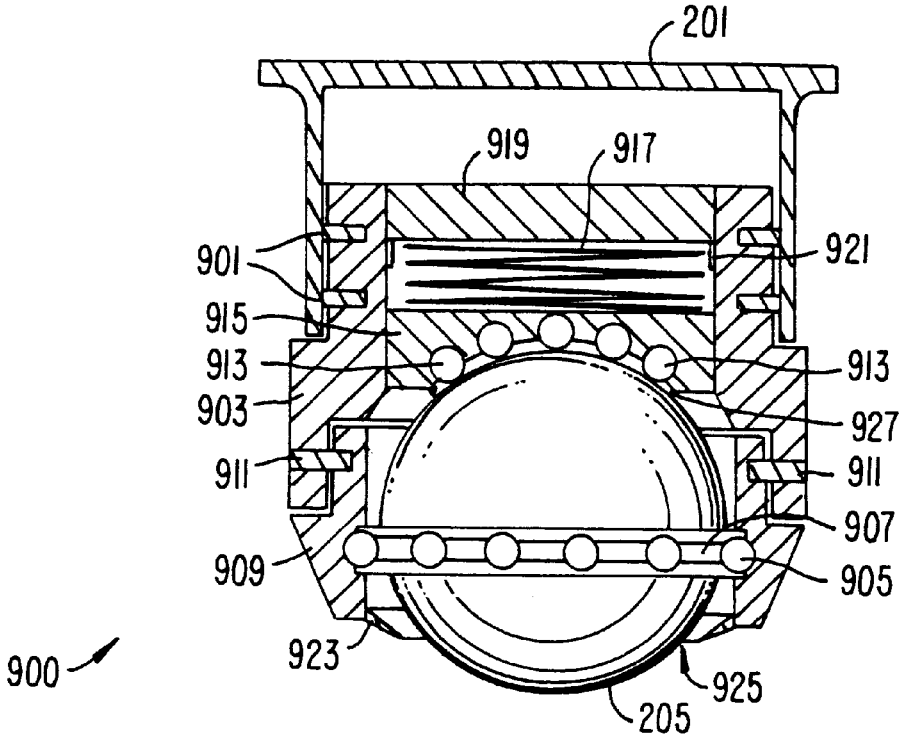
FIG. 9 is a cross-sectional illustration of the preferred roller assembly.

FIG. 9 is a cross-sectional view of a specific embodiment of a roller assembly 900. Assembly 900 is attached to skate frame 201 with a series of setscrews 901 although other methods of coupling the two components can be used, such as rivets, bolts, etc. Additionally, upper roller assembly housing portion 903 can be permanently or semi-permanently attached to skate frame 901, for example by bonding, welding, uni-piece construction, etc. The permanent or semi-permanent configuration is best suited for use in an inexpensive skate in which the user does not require the ability to quickly replace the roller assemblies.

Roller 205 is held within assembly 900 by two sets of bearings. A first set of bearings 905, held within a bearing cage 907, completely surrounds roller 205. Bearings 905 provide lateral support for roller 205. Bearing cage 907 and bearings 905 are held within a lower housing portion 909. During fabrication of assembly 900, roller 205 is first placed within the assembly and then lower housing portion 909 is attached to upper housing portion 903. Roller 205 is captured within assembly 900 since the diameter of roller 205 is larger than the inner diameter of the bearing assembly comprised of bearings 905 and cage 907. In one embodiment, lower housing 909 threads into upper housing 903. Preferably at least one setscrew 911 prevents the gradual loosening of the two housing portions. Alternately, the two housing portions can be assembled using any of a variety of other means ranging from means that allow easy disassembly, e.g., bolts, to means that are relatively inexpensive although semi-permanent, e.g., adhesives.

Figure 10:
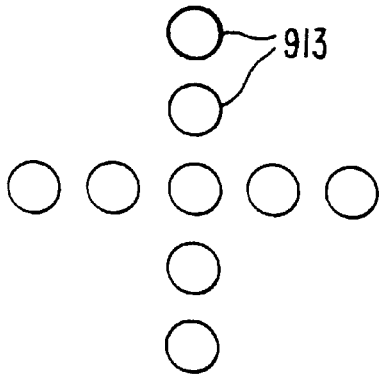
FIG. 10 illustrates the placement of the bearings in the upper set of bearings in the assembly shown in FIG. 9.

As roller 205 rotates within assembly 900, the upper surface remains in contact with a second set of bearings 913. The exact number and placement of bearings 913 within upper bearing housing 915 primarily depends upon such factors as the desired cost, weight of the expected skater, diameter of roller 205 and bearings 913, and expected use (e.g., professional roller hockey goalie versus free-style skater). Typically bearings 913 are arranged in a 'cross' pattern such as that shown in FIG. 10 although other bearing patterns (e.g., concentric circles) using fewer or greater numbers of bearings can also be used.

After assembly, roller 205 is held between the first set of bearings 905 and the second set of bearings 913. Therefore the ease with which roller 205 moves depends upon the amount of pressure exerted on the upper surface of roller 205 which is captured by the lower set of bearings. In the preferred embodiment of the invention the position of upper bearing housing 915 is adjustable, thus allowing the manufacturer and/or the user to be able to adjust the pressure. In the preferred embodiment of the invention shown in FIG. 9, bearing housing 915 is able to travel within upper assembly housing 903. Preferably a pressure applying component 917 such as a spring (e.g., coil spring, leaf spring, plate spring, elliptical springs, etc.) or an air bladder is mounted between the upper surface of housing 915 and an upper member 919 of housing portion 903. In order to prevent excessive travel of bearing housing 915 one or more travel stops 921 can be fitted between bearing housing 915 and housing portion 903.

Adjusting the pressure applied by bearings 913 and thus the freedom of motion of roller 205 can be accomplished in a number of ways. For example, if pressure applying component 917 is an air bladder, the air pressure within the bladder can be adjusted, either adding air to expand the bladder or releasing air to contract the bladder. The air bladder can be coupled to a valve mounted directly to skate frame 201 or assembly 900 that provides an easy way of adjusting the pressure without disassembling the skate or even removing the skate. Alternately, roller assembly 900 can be disassembled thereby allowing spring 917 to be replaced with a spring of a different tension. Alternately, the position of member 919 relative to housing portion 903 can be adjusted, thus allowing the pressure exerted by bearings 913 to be changed without changing component 917. For example, member 919 can be threaded into housing portion 903, thus allowing its position to be easily changed. Once member 919 is in the desired position, it can be locked into place with a setscrew or other means. Alternately, member 919 and bearing housing 915 can be rigidly coupled together (e.g., one piece construction), eliminating the need for component 917. In this configuration the position of the entire bearing housing 915 is adjusted, for example by threading the bearing housing in or out of upper housing portion 903, in order to obtain the desired bearing pressure.

The preferred embodiment of the invention includes a roller guard ring 923 attached to lower housing portion 909. Guard ring 923 helps to prevent dirt or other forms of contamination from entering roller assembly 900 and potentially damaging the bearings. Preferably spacing 925 between guard ring 923 and the surface of roller 205 is minimized, for example through the use of a compressible material (e.g., felt) or a low friction material (e.g., nylon).

Guard ring 923 can be permanently bonded to housing portion 909, or simply attached to housing portion 909 via screws or other means, thus allowing replacement of the guard ring as well as easy access to bearings 905 for routine maintenance (e.g., lubrication).

In addition to guard ring 923, this embodiment can also include a dirt and lubrication seal 927 attached to the bottom surface of bearing housing 915. Seal 927 helps to prevent contamination from entering bearings 913 as well as providing a seal for maintaining lubrication of bearings 913. It is understood that if a dry lubricant is used, such as a polymer coating applied to the retainer surfaces, the sealing qualities of seal 927 are of lesser importance.

Figure 11:
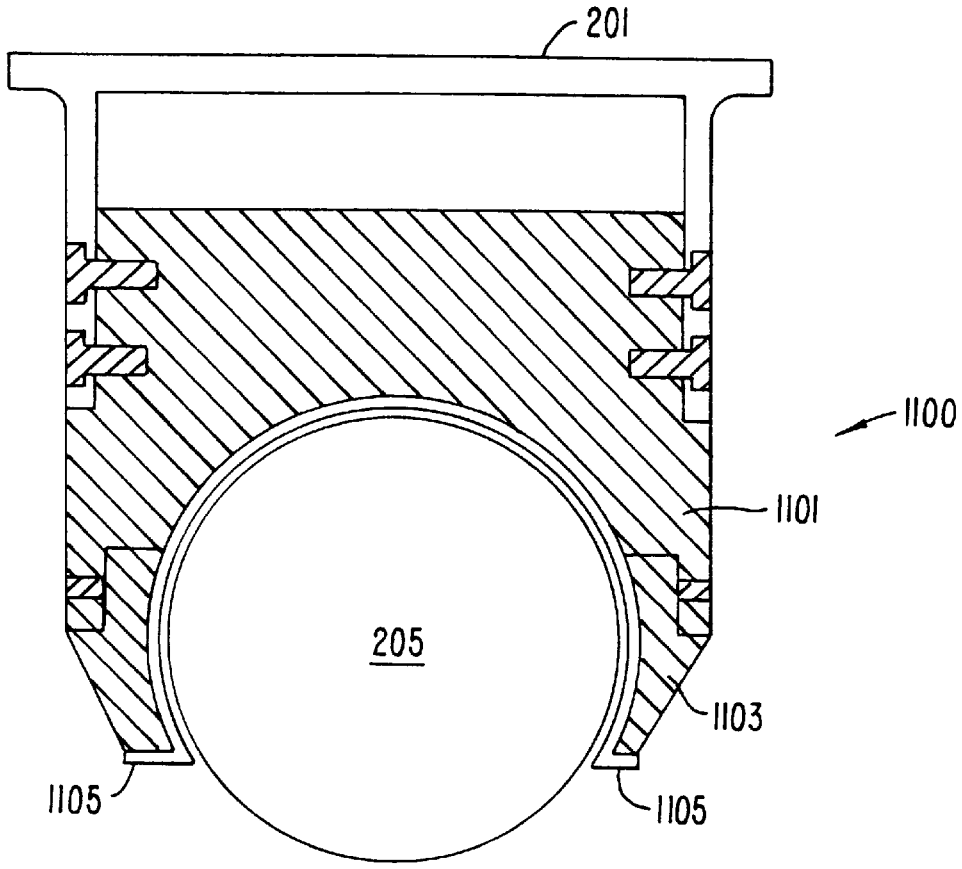
FIG. 11 is a cross-sectional view of an alternate embodiment of the roller assembly of the invention.

FIG. 11 is a cross-sectional view of an alternate embodiment of the invention. In this embodiment roller 205 is held within a housing assembly 1101 that is comprised of an upper housing portion 1101 and a lower housing portion 1103. When portions 101 and 1103 are mated together, the inner surfaces of the two portions form a spherical cavity with a slightly larger diameter than that of roller 205 which substantially encloses roller 205. The inner surfaces of both upper housing portion 1101 and lower housing portion 1103 are coated with a low friction coating (e.g., a polymer coating) that allows roller 205 to rotate easily. Upper housing portion 1101 is attached to frame 201 using bolts, rivets, or other means. Similarly, housing portions 1101 and 1103 are coupled together by threading one portion into the other, or through the use of bolts, rivets, adhesives, etc. A dust guard 1105 is attached to the opening of 1103 in order to prevent dirt or other forms of contamination from interfering with the smooth operation of roller 205. Preferably dust guard 1105 is bonded to lower housing portion 1103 and is fabricated from a material such as felt that efficiently gathers dust and is easily cleaned.

Figure 12:
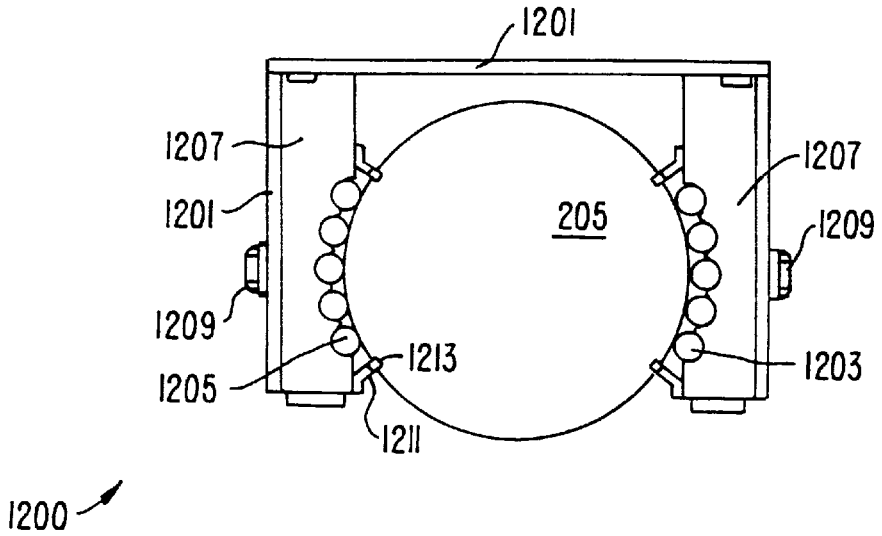
FIG. 12 is a cross-sectional front view of an alternate embodiment of the roller assembly of the invention.
Figure 13:
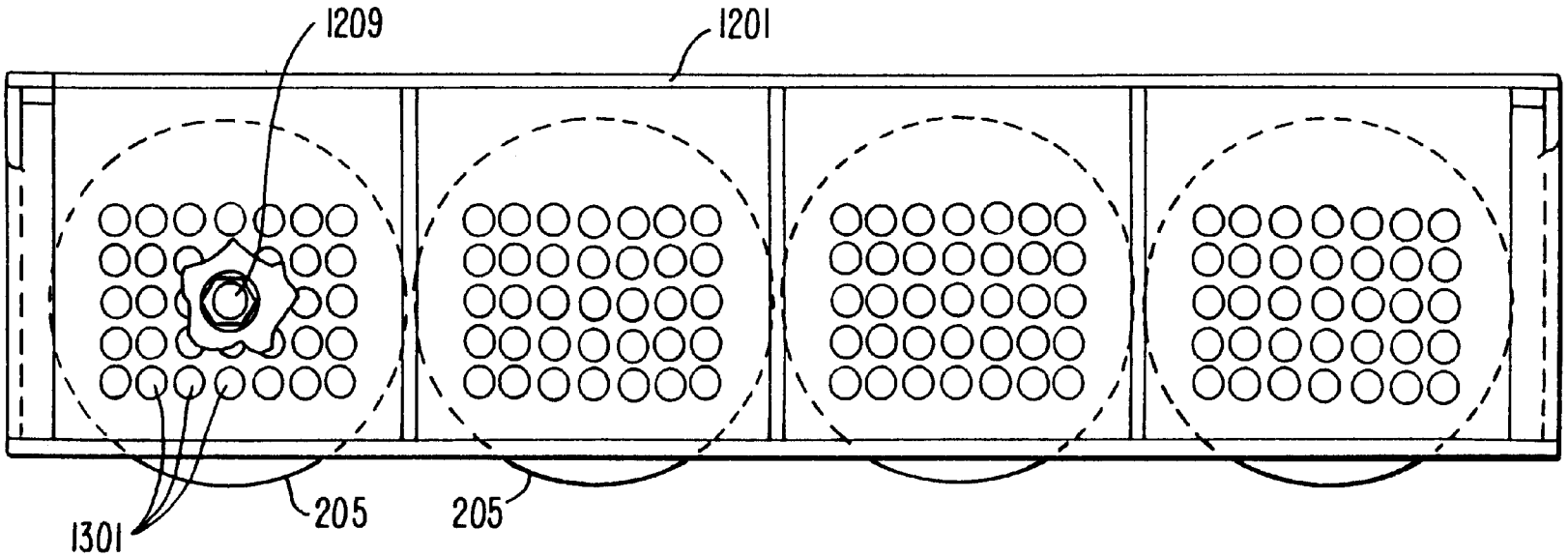
FIG. 13 is a cross-sectional side view of the embodiment of the roller assembly shown in FIG. 12.

FIGS. 12 and 13 provide cross-sectional front and side views, respectively, of another embodiment of the invention, specifically roller assembly 1200. Both figures show a portion 1201 of frame 201. In this embodiment, rollers 205 are held between two bearing sets 1203 and 1205. As shown in FIG. 13, each bearing set is comprised of 35 individual bearings 1301 thus providing coverage of approximately 30 percent of roller 205. As in the previous embodiments, both fewer and greater numbers of bearings can be used. The bearing sets are held against rollers 205 by a bearing retainer member 1207. Preferably bearing retainers 1207 are coupled to frame portion 1201 by tension adjusting bolts 1209, thereby allowing the pressure applied by bearings 1301 onto rollers 205 to be adjusted. As in assembly 900, the ability to adjust the pressure applied to the rollers is desirable as it allows the amount of effort required to rotate the roller to be controlled and tailored to the intended use as well as the experience of the user.

As in the previous embodiments, the bearings of this embodiment are preferably protected from damage due to contaminants using dust guards. In this embodiment a dust guard 1211 surrounds the entire set of bearings, i.e., bearing sets 1203 and 1205. Guard 1211 can be made of a flexible or spring-like material with a dust catching end portion 1213. End portion 1213 can be made of a material such as felt or nylon. Preferably either end portion 1213 or entire guards 1211 are easily replaceable, for example by bonding the end portions 1213 to guard members 1211 or by bolting an entire new dust guard 1211/1213 to retainers 1207.

It will be understood by those of skill in the art that guard ring 923, seal 927, guard 1105, guard 1211, and guard end portion 1213 of roller assemblies 900, 1100, and 1200, respectively, serve a dual purpose. Not only do they help prevent contamination from entering the bearing assemblies, they also help maintain proper lubrication of the bearing assemblies. This second purpose is less important if a dry lubricant (e.g., compatible polymer coating) is used than if a wet lubricant (e.g., grease) is used as in assembly 1100.

Rollers 205 can be fabricated from a variety of materials, depending upon the expected skating surface. Preferably rollers 205 are comprised of an inner core of a hard material (e.g., stainless steel) encased in an outer layer of a durable material (e.g., polyurethane) that provides the desired friction between the rolling or playing surface and the roller. In at least one embodiment of the invention, the user is provided with a choice of roller materials thus allowing the user to select the roller offering the best performance for the desired rolling or playing surface as well as the user's skating ability. Besides varying the outer material of the roller to enhance the friction characteristics of the roller, the selection of the outer material, the inner core (assuming a multi-layer roller), and the diameters of each can be varied in order to control the springiness of the rollers. Additionally and as previously noted, different outside diameters for rollers 205 can be used to accommodate skaters of varying weight and/or skill levels.

Preferably bearings 905 and 913 of assembly 900 and bearings 1301 of assembly 1200 can be fabricated from a metal such as stainless steel. Alternately, these bearings can be fabricated from a ceramic or a plastic (e.g., polyurethane, polypropylene, nylon, polytetrafluoroethylene, etc.).

As will be understood by those familiar with the art, the present invention may be embodied in other specific forms without departing from the spirit or essential characteristics thereof Accordingly, the disclosures and descriptions herein are intended to be illustrative, but not limiting, of the scope of the invention which is set forth in the following claims.

What is claimed is:

1. A skate assembly, comprising:

a skate assembly frame;

at least two wheel assemblies coupled to said skate assembly frame; and at least one roller assembly coupled to said skate assembly frame, said at least one roller assembly interposed between said at least two wheel assemblies, said at least one roller assembly comprising:

a roller assembly housing, said roller assembly housing comprised of a lower housing portion releaseably coupled to an upper housing portion; and a substantially spherical roller free to rotate within said roller assembly housing, wherein a portion of said substantially spherical roller lies outside of said roller assembly housing to act as a rolling surface, said at least one roller assembly further comprising:

a first plurality of bearings interposed between said upper housing portion and an upper portion of said substantially spherical roller; and a second plurality of bearings surrounding said substantially spherical roller in a first plane, wherein said first plane intersects said substantially spherical roller in a lower portion of said substantially spherical roller, wherein said second plurality of bearings is held in place by said lower housing portion.

2. The skate assembly of claim 1, said skate assembly comprised of three roller assemblies.

3. The skate assembly of claim 1, further comprising a friction plate coupled to said skate assembly frame.

4. The skate assembly of claim 3, said friction plate running continuously from a front portion of said skate assembly frame to a rear portion of said skate assembly frame.

5. The skate assembly of claim 1, wherein an outer layer of said substantially spherical roller is fabricated from polyurethane.

6. The skate assembly of claim 1, further comprising a skate boot coupled to said skate assembly frame.

7. The skate assembly of claim 1, further comprising:

a bearing retainer locating said first plurality of bearings; and a tension coupler flexibly coupling said bearing retainer to said upper housing portion, said tension coupler pressing said first plurality of bearings against said upper portion of said substantially spherical roller.

8. The skate assembly of claim 7, wherein said tension coupler is selected from the group consisting of coil springs, leaf springs, plate springs, elliptical springs and air bladders.

9. The skate assembly of claim 7, further comprising at least one travel stop, said at least one travel stop limiting motion of said tension coupler and said bearing retainer.

10. The skate assembly of claim 1, further comprising a guard ring coupled to said lower housing portion, said guard ring limiting contamination of said second plurality of bearings.

11. A skate assembly, comprising:

a skate assembly frame;

at least two wheel assemblies coupled to said skate assembly frame; and at least one roller assembly coupled to said skate assembly frame, said at least one roller assembly interposed between said at least two wheel assemblies, said at least one roller assembly comprising:

a roller assembly housing; and a substantially spherical roller free to rotate within said roller assembly housing, wherein a portion of said substantially spherical roller lies outside of said roller assembly housing to act as a rolling surface, said roller assembly housing further comprising:

an upper housing portion;

a lower housing portion releaseably coupled to said upper housing portion to form a partial spherical cavity of a larger diameter than a diameter corresponding to said substantially spherical roller;

a guard ring coupled to said lower housing portion, said guard ring limiting contamination of said partial spherical cavity; and a low friction coating applied to said partial spherical cavity.

12. A skate assembly, comprising:

a skate assembly frame;

at least two wheel assemblies coupled to said skate assembly frame; and at least one roller assembly coupled to said skate assembly frame, said at least one roller assembly interposed between said at least two wheel assemblies, said at least one roller assembly comprising:

a roller assembly housing;

a substantially spherical roller free to rotate within said roller assembly housing, wherein a portion of said substantially spherical roller lies outside of said roller assembly housing to act as a rolling surface;

a first bearing retainer coupled to a first side of said roller assembly housing;

a first plurality of bearings interposed between a first side of said substantially spherical roller and said first bearing retainer;

a second bearing retainer coupled to a second side of said roller assembly housing; and a second plurality of bearings interposed between a second side of said substantially spherical roller and said second bearing retainer.

13. The skate assembly of claim 12, said at least one roller assembly further comprising:

a first adjustable tension coupler flexibly coupling said first bearing retainer to said first side of said roller assembly housing; and a second adjustable tension coupler flexibly coupling said second bearing retainer to said second side of said roller assembly housing.

14. The skate assembly of claim 12, further comprising:

a first contamination guard coupled to said first bearing retainer, said first contamination guard limiting contamination of said first plurality of bearings; and a second contamination guard coupled to said second bearing retainer, said second contamination guard limiting contamination of said second plurality of bearings.

15. A skate assembly, comprising:

a skate assembly frame; and at least two roller assemblies coupled to said skate assembly frame, each of said at least two roller assemblies comprising:

a roller assembly housing comprised of a lower housing portion releaseably coupled to an upper housing portion;

a substantially spherical roller free to rotate within said roller assembly housing, wherein a portion of said substantially spherical roller lies outside of said roller assembly housing to act as a rolling surface;

a first plurality of bearings interposed between said upper housing portion and an upper portion of said substantially spherical roller;

a bearing retainer locating said first plurality of bearings;

a tension coupler flexibly coupling said bearing retainer to said upper housing portion, said tension coupler pressing said first plurality of bearings against said upper portion of said substantially spherical roller; and a second plurality of bearings surrounding said substantially spherical roller in a first plane, wherein said first plane intersects said substantially spherical roller in a lower portion of said substantially spherical roller, wherein said second plurality of bearings is held in place by said lower housing portion.

16. The skate assembly of claim 15, said skate assembly comprised of five roller assemblies.

17. The skate assembly of claim 15, further comprising a friction plate coupled to said skate assembly frame.

18. The skate assembly of claim 17, said friction plate running continuously from a front portion of said skate assembly frame to a rear portion of said skate assembly frame.

19. The skate assembly of claim 15, wherein an outer layer of said substantially spherical roller is fabricated from polyurethane.

20. The skate assembly of claim 15, further comprising a skate boot coupled to said skate assembly frame.

21. The skate assembly of claim 15, wherein said tension coupler is selected from the group consisting of coil springs, leaf springs, plate springs, elliptical springs and air bladders.

22. The skate assembly of claim 15, further comprising at least one travel stop, said at least one travel stop limiting motion of said tension coupler and said bearing retainer.

23. A skate assembly, comprising:

a skate assembly frame; and at least two roller assemblies coupled to said skate assembly frame, each of said at least two roller assemblies comprising:

a roller assembly housing comprised of a lower housing portion releaseably coupled to an upper housing portion;

a substantially spherical roller free to rotate within said roller assembly housing, wherein a portion of said substantially spherical roller lies outside of said roller assembly housing to act as a rolling surface;

a first plurality of bearings interposed between said upper housing portion and an upper portion of said substantially spherical roller;

a second plurality of bearings surrounding said substantially spherical roller in a first plane, wherein said first plane intersects said substantially spherical roller in a lower portion of said substantially spherical roller, wherein said second plurality of bearings is held in place by said lower housing portion; and a guard ring coupled to said lower housing portion, said guard ring limiting contamination of said second plurality of bearings.

24. A skate assembly, comprising:

a skate assembly frame; and at least two roller assemblies coupled to said skate assembly frame, each of said at least two roller assemblies comprising:

a roller assembly housing;

a substantially spherical roller free to rotate within said roller assembly housing, wherein a portion of said substantially spherical roller lies outside of said roller assembly housing to act as a rolling surface;

a first bearing retainer coupled to a first side of said roller assembly housing;

a first adjustable tension coupler flexibly coupling said first bearing retainer to said first side of said roller assembly housing;

a first plurality of bearings interposed between a first side of said substantially spherical roller and said first bearing retainer;

a second bearing retainer coupled to a second side of said roller assembly housing;

a second adjustable tension coupler flexibly coupling said second bearing retainer to said second side of said roller assembly housing;

a second plurality of bearings interposed between a second side of said substantially spherical roller and said second bearing retainer.

25. A skate assembly, comprising:

a skate assembly frame; and at least two roller assemblies coupled to said skate assembly frame, each of said at least two roller assemblies comprising:

roller assembly housing;

a substantially spherical roller free to rotate within said roller assembly housing, wherein a portion of said substantially spherical roller lies outside of said roller assembly housing to act as a rolling surface;

a first bearing retainer coupled to a first side of said roller assembly housing;

a first plurality of bearings interposed between a first side of said substantially spherical roller and said first bearing retainer;

a first contamination guard coupled to said first bearing retainer, said first contamination guard limiting contamination of said first plurality of bearings;

a second bearing retainer coupled to a second side of said roller assembly housing;

a second plurality of bearings interposed between a second side of said substantially spherical roller and said second bearing retainer; and a second contamination guard coupled to said second bearing retainer, said second contamination guard limiting contamination of said second plurality of bearings.

* * * * *